US008661717B2

(12) United States Patent
Miner

(10) Patent No.: US 8,661,717 B2
(45) **Date of Patent: *Mar. 4, 2014**

(54) ARTICLE OF FOOTWEAR WITH SLOTS AND METHOD OF MAKING

(75) Inventor: Mark C. Miner, Portland, OR (US)

(73) Assignee: Nike, Inc., Beaverton, OR (US)

( * ) Notice: Subject to any disclaimer, the term of this patent is extended or adjusted under 35 U.S.C. 154(b) by 738 days.

This patent is subject to a terminal disclaimer.

(21) Appl. No.: 12/860,141

(22) Filed: Aug. 20, 2010

(65) Prior Publication Data

US 2012/0042541 A1 Feb. 23, 2012

(51) Int. Cl.
*A43B 1/10* (2006.01)
*A43B 13/14* (2006.01)

(52) U.S. Cl.
USPC ..... 36/102; 36/25 R; 36/28

(58) Field of Classification Search
USPC ..... 36/102, 25 R, 28, 29, 30 A, 31
See application file for complete search history.

(56) References Cited

U.S. PATENT DOCUMENTS

| | | | | |
|---|---|---|---|---|
| D261,325 | S | 10/1981 | Niro | |
| 4,309,831 | A | 1/1982 | Pritt | |
| D275,148 | S | 8/1984 | Bergmans | |
| 4,578,882 | A | 4/1986 | Talarico, II | |
| D294,421 | S | 3/1988 | Le | |
| D294,653 | S | 3/1988 | Le | |
| D322,881 | S | 1/1992 | Bushman | |
| 5,797,199 | A | 8/1998 | Miller et al. | |
| 6,009,637 | A | 1/2000 | Pavone | |
| 6,023,859 | A | 2/2000 | Burke et al. | |
| D474,580 | S | 5/2003 | Pollastrelli | |
| D475,508 | S | 6/2003 | Pollastrelli | |
| 6,931,764 | B2 | 8/2005 | Swigart et al. | |
| 6,966,128 | B2 | 11/2005 | McClaskie | |
| 6,976,320 | B2 | 12/2005 | McClaskie | |
| 7,290,357 | B2 | 11/2007 | McDonald et al. | |
| 7,350,320 | B2 * | 4/2008 | Chandler et al. | 36/28 |
| 7,401,418 | B2 | 7/2008 | Wyszynski et al. | |
| 7,401,419 | B2 | 7/2008 | Lucas et al. | |
| D574,582 | S | 8/2008 | Della Valle | |
| D577,179 | S | 9/2008 | Della Valle | |
| D577,181 | S | 9/2008 | Della Valle | |
| 8,001,703 | B2 | 8/2011 | Schindler et al. | |
| 8,151,485 | B2 | 4/2012 | Hurd et al. | |
| 2004/0024645 | A1 | 2/2004 | Potter et al. | |
| 2005/0071242 | A1 | 3/2005 | Allen et al. | |

(Continued)

FOREIGN PATENT DOCUMENTS

| | | |
|---|---|---|
| DE | 102005006267 | 3/2006 |
| EP | 1787540 | 5/2007 |
| EP | 2198729 | 6/2010 |

OTHER PUBLICATIONS

International Search Report and Written Opinion mailed Dec. 22, 2011 in International Application No. PCT/US2011/048165.

(Continued)

*Primary Examiner* — Ted Kavanaugh
(74) *Attorney, Agent, or Firm* — Plumsea Law Group, LLC

(57) ABSTRACT

A sole structure for an article of footwear and a method of making the sole structure is disclosed. The sole structure can include a plurality of slots. The slots are associated with connecting portions that connect portions of the sole structure in the generally longitudinal direction and provide for increased fit, flexibility and stability.

20 Claims, 7 Drawing Sheets

(56) References Cited

U.S. PATENT DOCUMENTS

| | | | | |
|---|---|---|---|---|
| 2006/0117604 | A1 | 6/2006 | Fusco | |
| 2006/0201028 | A1 | 9/2006 | Chan et al. | |
| 2007/0199211 | A1 | 8/2007 | Campbell | |
| 2007/0199213 | A1 | 8/2007 | Campbell et al. | |
| 2008/0022553 | A1 | 1/2008 | McDonald et al. | |
| 2008/0244926 | A1 | 10/2008 | Yu et al. | |
| 2008/0289224 | A1 | 11/2008 | Sink | |
| 2009/0071040 | A1 | 3/2009 | Fergus | |
| 2010/0083535 | A1 | 4/2010 | Meschter et al. | |
| 2010/0154257 | A1 * | 6/2010 | Bosomworth et al. | 36/30 R |
| 2010/0269271 | A1 | 10/2010 | Kim et al. | |

OTHER PUBLICATIONS

International Preliminary Report on Patentability (including Written Opinion of the ISA) mailed Mar. 7, 2013 in International Application No. PCT/US2011/048163.

International Preliminary Report on Patentability (including Written Opinion of the ISA) mailed Mar. 7, 2013 in International Application No. PCT/US2011/048164.

International Preliminary Report on Patentability (including Written Opinion of the ISA) mailed Mar. 7, 2013 in International Application No. PCT/US2011/048165.

Office Action mailed Feb. 28, 2013 in U.S. Appl. No. 12/860,173.

Office Action mailed Mar. 20, 2013 in U.S. Appl. No. 12/860,153.

* cited by examiner

ARTICLE OF FOOTWEAR WITH SLOTS AND METHOD OF MAKING

BACKGROUND

The present invention relates generally to an article of footwear, and in particular to an article of footwear with grooves and a method of making the article.

Articles of footwear with slots or grooves are known. Meschter et al. (U.S. patent application publication number 2010/0083535), the entirety of which is incorporated by reference, teaches an article of footwear having an upper decoupled from the sole in a midfoot region. Shaffer teaches lateral and medial recesses that are cut into the side of the sole in the longitudinal direction.

Fergus (U.S. patent application publication number 2009/0071040) teaches a felt sole with improved traction. The felt sole has integral downwardly extending protrusions located over the bottom surface of the felt sole. Fergus teaches that methods for creating the traction pattern can include cutting or laser burning the pattern into one surface of the flat felt sheet.

Campbell (U.S. patent application publication number 2007/0199211) teaches a flexible foot-support structure. Campbell teaches a shoe with an outsole that includes at least two recessed segments extending in a longitudinal direction in the forefoot portion. Campbell teaches that the recessed segments can be provided in the sole structure in any desired manner, such as during a sole member molding process, by a cutting action (e.g. using knives, lasers, etc.), and/or any other manner.

McClaskie (U.S. Pat. No. 6,976,320) teaches a sandal or shoe having an outsole with a sock lining on top of and in direct contact with the outsole for directing contacting a user's foot and a cushion having a thickness between approximately ⅛ and 1½ inches, where the cushion is placed between the outsole and the sock lining. McClaskie teaches a notch, which is any recess, indentation, relief, channel groove, or etching in the side surface of the outsole sufficient to provide clearance for the securing mechanism. McClaskie further teaches that the notch can be formed using machining, molding, grinding, etching or laser cutting.

SUMMARY

In one aspect, the invention provides an article of footwear, comprising: a sole structure including a side portion, a lower portion and a lower periphery disposed between the side portion and the lower portion; a first slot disposed in the side portion and a second slot disposed in the lower portion; the first slot having a first end portion disposed adjacent to the lower periphery; the second slot having a second end portion disposed adjacent to the lower periphery; a connecting portion extending to the lower periphery; and where the connecting portion separates the first slot from the second slot.

In another aspect, the invention provides an article of footwear, comprising: a sole structure including a side portion, a lower portion and an upper portion; a lower periphery disposed between the side portion and the lower portion; an upper periphery disposed between the side portion and the upper portion; a first slot disposed in the side portion and a second slot disposed in the lower portion; a first connecting portion being disposed between a first portion of the first slot and the upper portion, the first connecting portion extending to the upper periphery; a second connecting portion being disposed between a second portion of the first slot and a portion of the second slot, the second connecting portion extending to the lower periphery; and where the first connecting portion is configured to move substantially independently of the second connecting portion.

In another aspect, the invention provides an article of footwear, comprising: a sole structure comprising a lateral side portion, a medial side portion and a lower portion; the sole structure further comprising a first portion and a second portion, the first portion and the second portion having an approximately rectangular cross-sectional shape; a hollowed out portion disposed between the first portion and the second portion, the hollowed out portion comprising a first slot disposed on the lateral side portion, a second slot disposed on the medial side portion and a third slot disposed on the lower portion; the hollowed out portion further comprising a first connecting portion associated with a lateral upper periphery of the sole structure, a second connecting portion associated with a lateral lower periphery of the sole structure, a third connecting portion associated with a medial lower periphery of the sole structure and a fourth connecting portion associated with a medial upper periphery of the sole structure; and where the first connecting portion is attached to the second connecting portion and wherein the third connecting portion is attached to the fourth connecting portion.

In another aspect, the invention provides a method of making a sole structure for an article of footwear, comprising the steps of: removing material from a side portion of the sole structure to form a first slot and thereby forming a first connecting portion in the sole structure, the first connecting portion extending to an upper periphery of the sole structure; removing material from a lower portion of the sole structure to form a second slot and thereby forming a second connecting portion in the sole structure, the second connecting portion extending to a lower periphery of the sole structure; and where the first connecting portion is connected to the second connecting portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
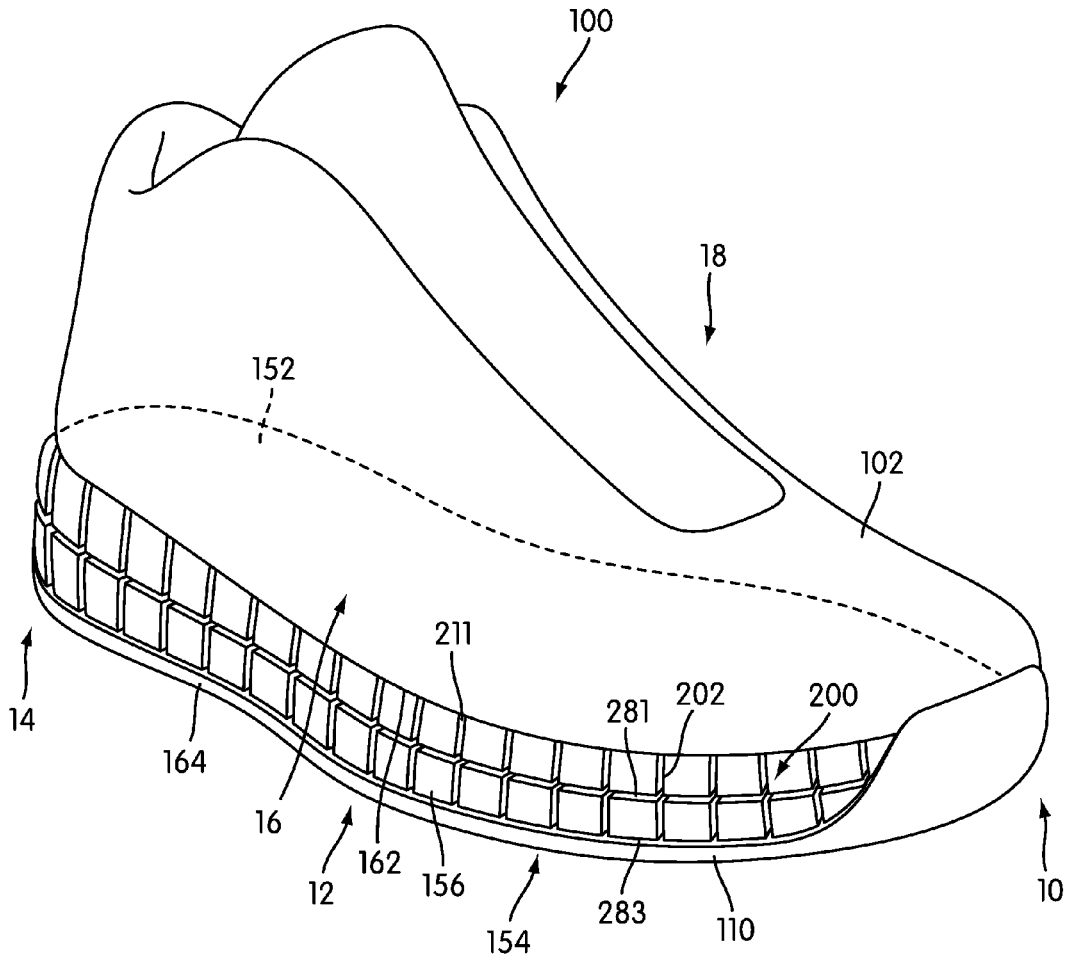
FIG. 1 is an isometric view of an embodiment of an article of footwear including a plurality of slots.
Figure 2:
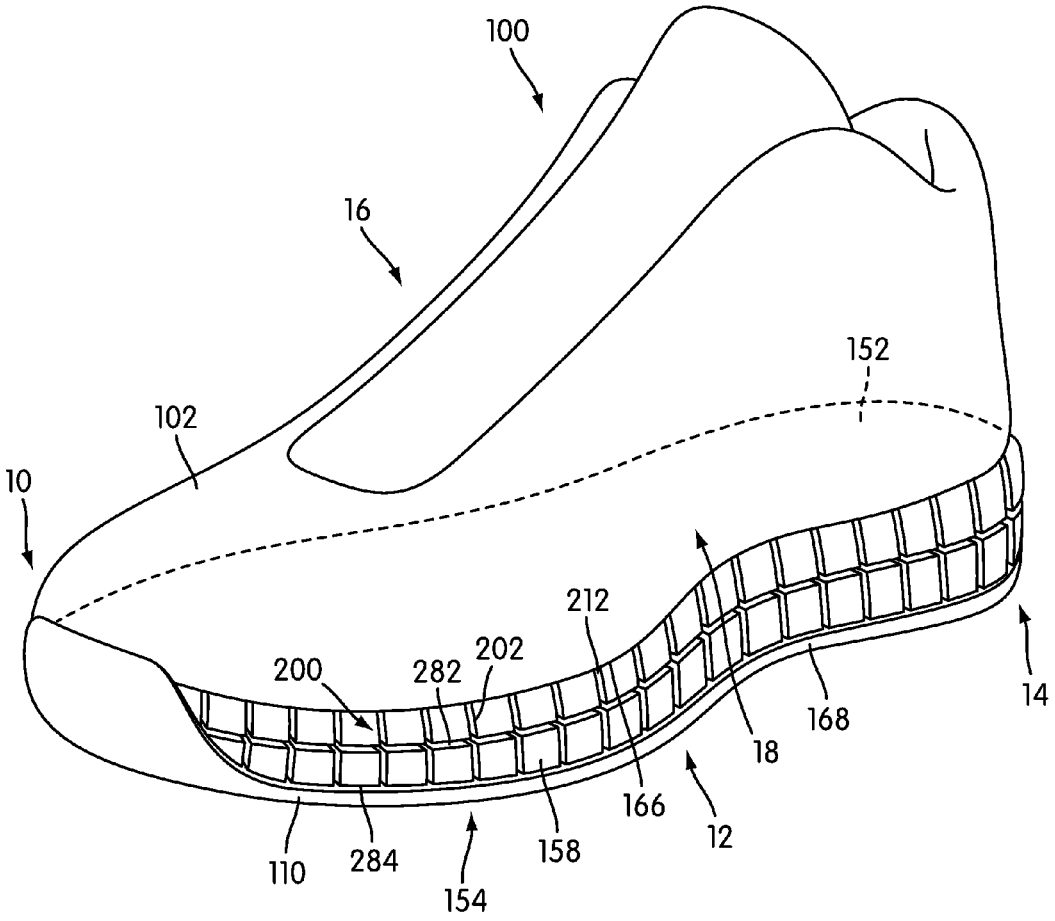
FIG. 2 is an isometric view of an embodiment of an article of footwear including a plurality of slots.
Figure 3:
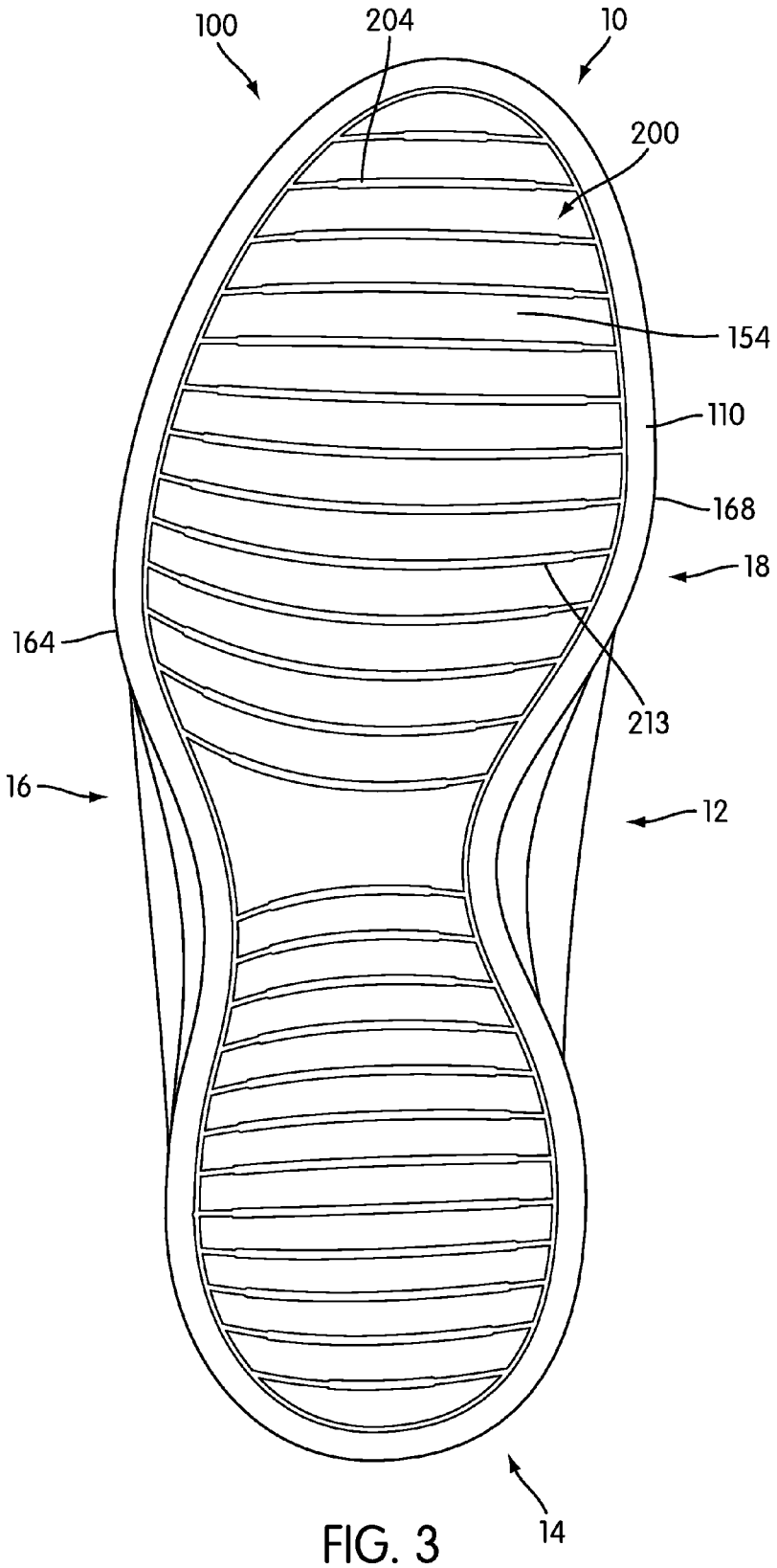
FIG. 3 is a bottom view of an embodiment of an article of footwear including a plurality of slots.

FIGS. 1 through 3 illustrate views of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 through 3, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 3, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Sole structure 110 can include upper portion 152 (seen in phantom in FIGS. 1 and 2) and lower portion 154 disposed opposite of upper portion 152. In some cases, upper portion 152 can be disposed adjacent to upper 102. In addition, in some cases, lower portion 154 can be a ground contacting surface. Sole structure 110 can further include lateral side portion 156 and medial side portion 158. Lateral side portion 156 may extend between upper portion 152 and lower portion 154 on lateral side 16 of sole structure 110. Likewise, medial side portion 158 may extend between upper portion 152 and lower portion 154 on medial side 18 of sole structure 110.

In some embodiments, sole structure 110 can include lateral upper periphery 162 disposed between lateral side portion 156 and upper portion 152. Also, sole structure 110 can include lateral lower periphery 164 disposed between lateral side portion 156 and lower portion 154. Furthermore, sole structure 110 can include medial upper periphery 166 disposed between medial side portion 158 and upper portion 152. Also, sole structure 110 can include medial lower periphery 168 disposed between medial side portion 158 and lower portion 154.

A sole structure can include provisions for increasing flexibility, fit and stability for an article of footwear. In some embodiments, a sole structure can be provided with one or more slots. In some cases, slots can be provided on a side portion of the sole structure. In other cases, slots can be provided on a lower portion of the sole structure. In one embodiment, slots can be provided on side portions of the sole structure as well as on lower portions of the sole structure.

In one embodiment, sole structure 110 can include plurality of slots 200. Generally, plurality of slots 200 can comprise various slots arranged in a variety of orientations and in a variety of locations on sole structure 110. For example, in some embodiments, plurality of slots 200 may include first slot set 202 that extend in a generally vertical direction on lateral side portion 156 and medial side portion 158. Additionally, plurality of slots 200 may include first longitudinal slot 281 that extends in a longitudinal direction along lateral side portion 156 and second longitudinal slot 282 that extends in a longitudinal direction along medial side portion 158. In some cases, plurality of slots 200 may further include third longitudinal slot 283 that extends in a longitudinal direction along lateral side portion 156 and fourth longitudinal slot 284 that extends in a longitudinal direction along medial side portion 158. In this embodiment, first longitudinal slot 281, second longitudinal slot 282, third longitudinal slot 283 and fourth longitudinal slot 284 may intersect slots from first slot set 202. Furthermore, plurality of slots 200 may include second slot set 204 disposed on lower portion 154. In some cases, second slot set 204 may extend in a generally lateral direction on sole structure 110.

In different embodiments, the number of slots comprising plurality of slots 200 can vary. For example, in one embodiment, first slot set 202 can comprise between 1 and 100 slots. In another embodiment, first slot set 202 can comprise between 40 and 70 slots. In still other embodiments, first slot set 202 can include more than 100 slots. In addition, in some embodiments, second slot set 204 can include between 1 and 30 slots. In other embodiments, second slot set 204 can include more than 30 slots. Still further, while plurality of slots 200 comprises four longitudinal slots disposed on medial side portion 158 and lateral side portion 156, in other embodiments, plurality of slots 200 could comprise additional longitudinal slots. In still other embodiments, plurality of slots 200 may not include any longitudinal slots on lateral side portion 156 or medial side portion 158. In still other embodiments, plurality of slots 200 may comprise between 1 and 3 longitudinal slots on lateral side portion 156 and/or medial side portion 158.

In some embodiments, first slot set 202 may not extend through medial lower periphery 168. Likewise, in some cases, first slot set 202 may not extend through lateral lower periphery 164. Additionally, in some embodiments, second slot set 204 may not extend through medial lower periphery 168. Also, second slot set 204 may not extend through lateral lower periphery 164. In other words, medial lower periphery 168 and later lower periphery 164 may be boundaries for first slot set 202 and second slot set 204.

Generally, the arrangement of one or more slots on a sole structure can vary. In some cases, one or more slots may have a linear configuration or shape. In other cases, one or more slots may have a nonlinear configuration or shape. It will be understood that the term "nonlinear configuration" is not intended to be limited to a particular type of nonlinear shape or arrangement. For example, a nonlinear configuration for one or more slots can include smooth nonlinear shapes such as sinusoidal shapes, wavy shapes, as well as other smooth nonlinear shapes. Also, a nonlinear configuration for one or more slots can include polygonal nonlinear shapes with edges such as zig-zag shapes, triangle wave shapes, square wave shapes, as well as any other types of non-smooth nonlinear shapes. Furthermore, in some cases, one or more slots can be associated with a regular nonlinear configuration that includes repeating patterns. In other cases, however, one or more slots can be associated with an irregular nonlinear configuration that does not include repeating patterns. In still other cases, one or more slots can be associated with a nonlinear configuration that includes some portions with repeating patterns and other portions with non-repeating patterns.

In the exemplary embodiment, first slot set 202 may include slots that have a slightly curved shape. In other cases, first slot set 202 may include slots that have a substantially linear shape. Furthermore, in some cases, second slot set 204 may include slots with substantially curved shapes. For example, some slots of second slot set 204 may have arc-like shapes. In some cases, the amount of arcing can decrease as the distance of each slot from midfoot portion 12 increases. In other embodiments, however, any other linear or nonlinear configurations for first slot set 202 and/or second slot set 204 are possible. In addition, in different embodiments, any type of linear or nonlinear configuration can be used for first longitudinal slot 281, second longitudinal slot 282, third longitudinal slot 283 and/or fourth longitudinal slot 284.

In different embodiments, the dimensions of one or more slots of first slot set 202 can vary. In some embodiments, the heights of each slot in first slot set 202 in the generally vertical direction can vary. For example, in one embodiment, slots of first slot set 202 disposed in forefoot portion 10 may be shorter than slots of first slot set 202 disposed in heel portion 14. In other cases, however, the heights of each slot in first slot set 202 can vary in another manner.

Additionally, the widths of each slot in first slot set 202, which may be measured along a generally longitudinal direction, can vary. In some cases, each slot in first slot set 202 can have a substantially similar width. In other cases, two or more slots in first slot set 202 can have substantially different widths.

In some embodiments, the lengths of slots in second slot set 204, as measured in a generally lateral direction on lower portion 154, can vary. In some cases, each slot can have a substantially similar length. In other cases, however, the length of each slot can vary with the width of sole structure 110. For example, in the current embodiment, each slot of second slot set 204 may have a length that is proportional to the width of sole structure 110 in the region associated with the slot.

In some embodiments, the widths of slots in second slot set 204, as measured in a generally longitudinal direction on lower portion 154, can vary. In some cases, each slot can have a substantially similar width. In other cases, however, the width of each slot in second slot set 204 can vary. Furthermore, in some embodiments, the widths of each slot may vary along the length of the slot. For example, in the current embodiment, the widths of each slot in second slot set 204 may be larger towards the center portions of each slot, and narrower at the end portions of each slot. In other embodiments, however, the widths of each slot in second slot set 204 can vary in other manners.

In some embodiments, the lengths of one or more longitudinal slots can vary. In some cases, the length of each longitudinal slot can extend along a substantial length of a sole structure. In other cases, the lengths of each longitudinal slot can be substantially shorter than the length of the sole structure. In addition, each longitudinal slot can have widths that vary. Furthermore, in some cases, the depths of each longitudinal slot can vary.

In some embodiments, slots on different portions of a sole structure can be generally aligned with one another with respect to the longitudinal direction. For example, in some cases, slots on the side portions of a sole structure may be generally aligned with slots on the lower portion of the sole structure. In other words, these slots may be associated with approximately similar longitudinal positions. In other embodiments, however, slots on the side portions may not be aligned with slots on the lower portion. Furthermore, it will be understood that in some embodiments, only some slots may be generally aligned on side portions and lower portions of the sole structure, while other slots may not be aligned.

Figure 4:
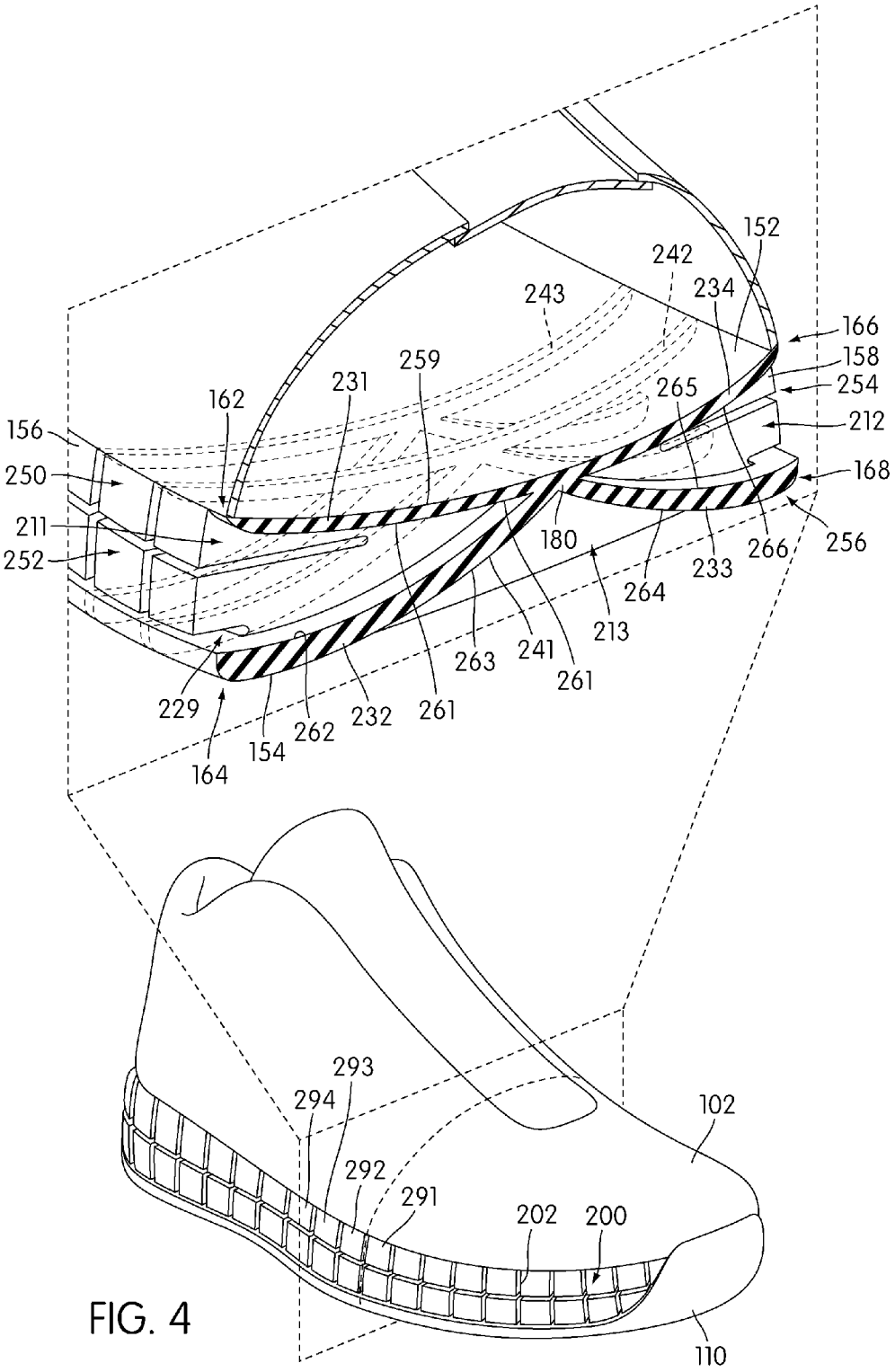
FIG. 4 is an enlarged cut away view of an embodiment of an article of footwear including a plurality of slots.
Figure 5:
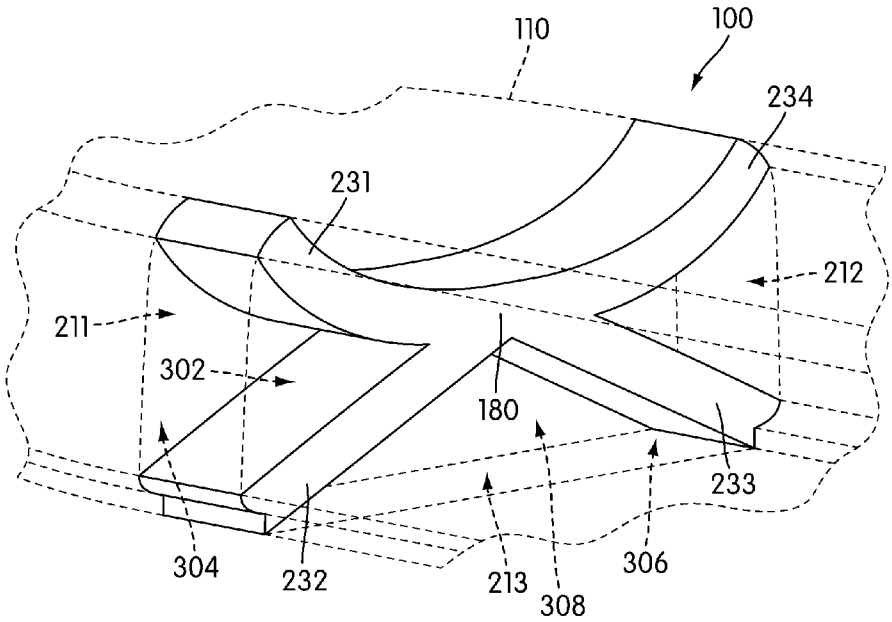
FIG. 5 is an enlarged schematic view of an embodiment of several slots associated with a plurality of connecting portions.

In some embodiments, one or more slots from first slot set 202 may correspond for one or more slots from second slot set 204. In some cases, some slots of first slot set 202 may be approximately aligned with some slots from second slot set 204. It will be understood that the approximate alignment between some slots refers to an approximately similar location for these slots along the longitudinal direction of article 100. For example, in the current embodiment, first slot 211 and second slot 212, disposed on lateral side portion 156 and medial side portion 158, respectively, may be approximately aligned with third slot 213, which is disposed on lower portion 154. This approximate alignment of first slot 211, second slot 212 and third slot 213 is illustrated in FIGS. 4 and 5, which are discussed in detail below.

In a similar manner, other slots of first slot set 202 may be approximately aligned with slots of second slot set 204. In other embodiments, however, slots of first slot set 202 may not be aligned with slots of second slot set 204. In addition, in some cases, only some slots of first slot set 202 and second slot set 204 may be aligned. In particular, in embodiments where there is a greater number of slots on medial side portion 158 than the number of slots of second slot set 204, it may not be possible to align all of the slots of first slot set 202 located on medial side portion 158 with each of the slots of second slot set 204. Similarly, in embodiments where there is a greater number of slots on lateral side portion 156 than the number of slots of second slot set 204, it may not be possible to align all of the slots of first slot set 202 located on lateral side portion 156 with each of the slots of second slot set 204.

In some embodiments, slots can provide means for decoupling portions of a sole in order to enhance fit, flexibility and stability for an article of footwear. For example, in some cases, slots can be applied to side portions and lower portions of a sole structure to reduce the cross sectional profile of the sole structure at particular regions and to facilitate increased flexibility between various portions of the sole structure. In an exemplary embodiment, slots can be applied to side portions and lower portions to form connecting portions between adjacent portions of the sole structure that articulate with respect to one another.

In different embodiments, sole structure 110 could be comprised of one or more components. In some embodiments, sole structure 110 could include an outsole layer that may be associated with a lower surface of sole structure 110. In some cases, an outsole layer could be disposed over the entirety of lower portion 154 in a manner that covers one or more slots. In some cases, the outsole layer could provide a protective covering to prevent dirt and debris from entering one or more slots on lower portion 154. In other cases, an outsole layer could comprise a webbing arrangement. For example, in some cases, the outsole layer could comprise gaps that correspond to the one or more slots on lower portion 154. In still other embodiments, an outsole layer can be applied in any other manner. Moreover, in some cases, no outsole layer may be used. In such cases, sole structure 110 could comprise a midsole which contacts a ground surface directly.

FIG. 4 illustrates an embodiment of a cut away view of a portion of sole structure 110, which is taken at a longitudinal location that approximately corresponds to the locations of first slot 211, second slot 212 and third slot 213. Referring to FIG. 4, first slot 211, second slot 212 and third slot 213 each extend from outer surface 250 of sole structure 110 towards central portion 180 of sole structure 110. For example, first slot 211 extends from outer lateral surface 252 of lateral side portion 156 to central portion 180. Similarly, second slot 212 extends from outer medial surface 254 of medial side portion 158 to central portion 180. Furthermore, third slot 213 extends from outer lower surface 256 of lower portion 154 to central portion 252.

In some embodiments, first slot 211, second slot 212 and third slot 213 may be further associated with one or more connecting portions. The term "connecting portion" as used throughout this detailed description and in the claims, refers to a portion of a sole structure that helps to join adjacent portions of a sole structure that are partially separated by one or more slots in a substantially longitudinal direction. In some cases, two or more connecting portions that are joined together can comprise a connecting member. In an exemplary embodiment, first slot 211, second slot 212 and third slot 213 may be associated with first connecting portion 231, second connecting portion 232, third connecting portion 233 and fourth connecting portion 234.

In some cases, first connecting portion 231 may be a portion of sole structure 110 that bounds a portion of first slot 211. In particular, first connecting portion 231 may bound an upper portion of first slot 211. In some cases, first connecting portion 231 may extend from central portion 180 to lateral upper periphery 162 of sole structure 110. Furthermore, first connecting portion 231 may have an upper surface that corresponds to upper surface 259 of upper portion 152. First connecting portion 231 may also include first inner surface 261 that is associated with an inner surface of first slot 211.

In some embodiments, second connecting portion 232 may be a portion of sole structure 110 that is disposed between first slot 211 and third slot 213. In other words, second connecting portion 232 may bound portions of both first slot 211 and third slot 213. In some cases, second connecting portion 232 may extend from central portion 180 to lateral lower periphery 164. In addition, second connecting portion 232 can include second inner surface 262 that is associated with an inner surface of first slot 211. Also, second connecting portion 232 can include third inner surface 263 that is associated with an inner surface of third slot 213.

In some embodiments, third connecting portion 233 may be a portion of sole structure 110 that is disposed between second slot 212 and third slot 213. In other words, third connecting portion 233 may bound portions of both second slot 212 and third slot 213. In some cases, third connecting portion 233 may extend from central portion 180 to medial lower periphery 168. In addition, third connecting portion 233 can include fourth inner surface 264 that is associated with an inner surface of third slot 213. Also, third connecting portion 233 can include fifth inner surface 265 that is associated with an inner surface of second slot 212.

In some embodiments, fourth connecting portion 234 may be a portion of sole structure 110 that bounds a portion of second slot 212. In particular, fourth connecting portion 234 may bound an upper portion of second slot 212. In some cases, fourth connecting portion 234 may extend from central portion 180 to medial upper periphery 166. Furthermore, fourth connecting portion 234 may have an upper surface that corresponds to upper surface 259 of upper portion 152. Fourth connecting portion 234 may also include sixth inner surface 266 that is associated with an inner surface of second slot 212.

Using this arrangement, first connecting portion 231, second connecting portion 232, third connecting portion 233 and fourth connecting portion 234 can comprise first connecting member 241. In some cases, first connecting member 241 may help connect first sole portion 291 and second sole portion 292, which are partially separated by first slot 211, second slot 212 and third slot 213. In other words, first connecting member 241 may help prevent first sole portion 291 and second sole portion 292 from being completely decoupled.

In some embodiments, other slots of plurality of slots 200 can be aligned in similar manners to form additional hollowed out portions for sole structure 110. These slots can be further associated with connecting members that provide connecting material between adjacent sections of sole structure 110. For example, in some embodiments, first connecting member 241 may be configured to provide connecting material between first sole portion 291 and second sole portion 292. In a similar manner, second connecting member 242, shown in phantom, provides connecting material between second sole portion 292 and third sole portion 293. In a similar manner, third connecting member 243 is configured to provide connecting material between third sole portion 293 and fourth sole portion 294. Likewise, sole structure 110 can include additional hollowed out portions that are formed by slots aligned along side portions and a lower portion of sole structure 110 that form a connected core for sole structure 110. This arrangement allows for some decoupling between adjacent portions in a generally longitudinal direction and can increase the flexibility of sole structure 110, providing enhanced flexibility for a user of article 100. In addition, the partially decoupled portions of sole structure 110 can better conform to the shape of a foot to enhance fit. Still further, the partially decoupled portions can move somewhat independently to adjust to changes in position of article 100, which allows for enhanced stability for a user.

Figure 6:
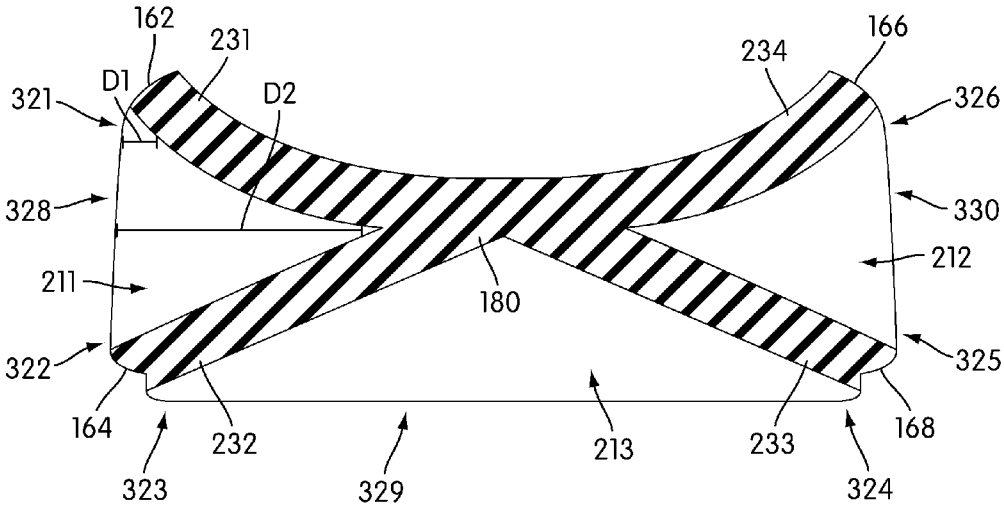
FIG. 6 is a schematic cross-sectional view of an embodiment of a connecting member for a sole structure.

FIGS. 5 and 6 are intended to illustrate details of the configurations of first slot 211, second slot 212 and third slot 213, as well as the configurations of first connecting portion 231, second connecting portion 232, third connecting portion 233 and fourth connecting portion 234. Although these embodiments discuss a particular group of slots and connecting portions associated with hollowed out portion 229, it will be understood that the principles discussed here could be applied to any other group of slots that are aligned in a generally longitudinal direction to create a hollowed out portion, including a plurality of connecting members.

As discussed above, one or more slots on a sole structure can be substantially aligned in a generally longitudinal direction to provide a hollowed out portion for the sole structure. In some embodiments, the front and rear walls of one or more slots may be substantially aligned. For example, in some cases, the front wall of a slot on a lateral side portion of a sole structure can be substantially aligned in a longitudinal direction with a front wall of a slot on a lower portion of the sole structure. Similarly, the rear walls of the slot on the side portion and the slot on the lower portion can be approximately aligned in the longitudinal direction.

FIG. 5 illustrates an embodiment of an enlarged view of a section of article 100 including first slot 211, second slot 212 and third slot 213. In this case, portions of sole structure 110 are shown in phantom, while first connecting portion 231, second connecting portion 232, third connecting portion 233 and fourth connecting portion 234 are illustrated in solid lines. Referring to FIG. 5, first slot 211, second slot 212 and third slot 213 may be approximately aligned in the longitudinal direction, as discussed above. For example, first slot 211 may be associated with first front wall 302 and first rear wall 304, which bound first slot 211 in a generally longitudinal direction. Likewise, third slot 213 may be associated with second front wall 306 and second rear wall 308, which bound third slot 213 in a generally longitudinal direction. In an exemplary embodiment, first front wall 302 and second front wall 306 may be approximately aligned with respect to the longitudinal direction. Likewise, first rear wall 304 and second rear wall 308 may be approximately aligned with respect to the longitudinal direction. In a similar manner, front and rear walls of second slot 212 may be approximately aligned with the front and rear walls of first slot 211 and third slot 213. By aligning corresponding walls of first slot 211, second slot 212 and third slot 213 in the generally longitudinal direction, the overall flexibility between adjacent sole portions of sole structure 110 may be enhanced.

Referring now to FIG. 6, the geometries and orientations of first connecting portion 231, second connecting portion 232, third connecting portion 233 and fourth connecting portion 234 may vary. For example, in the current embodiment, first connecting portion 231 and fourth connecting portion 234 have substantially curved or rounded geometries. In contrast, in the current embodiment, second connecting portion 232 and third connecting portion 233 may have substantially linear geometries. Furthermore, in this embodiment, each connecting portion extends generally from central portion 180 to peripheries, or corners, of sole structure 110. For example, in the current embodiment, first connecting portion 231 extends from central portion 180 to lateral upper periphery 162. Additionally, second connecting portion 232 extends from central portion 180 to lateral lower periphery 164. Also, third connecting portion 233 extends from central portion 180 to medial lower periphery 168. Also, fourth connecting portion 234 extends from central portion 180 to medial upper periphery 166. With this arrangement, first connecting portion 231, second connecting portion 232, third connecting portion 233 and fourth connecting portion 234 may be arranged in an X-like configuration.

In other embodiments, however, each connecting portion can have other geometries. For example, in another embodiment, one or more connecting portions could have an L-like shape or geometry. In still other embodiments, each connecting portion could have any other type of geometry. Furthermore, while the current embodiment illustrates an X-like configuration for the connecting portions, in other embodiments connecting portions could be arranged in other ways. As an example, in another embodiment the connecting portions could be arranged in an I-beam like configuration. Additionally, while first connecting portion 231, second connecting portion 232, third connecting portion 233 and fourth connecting portion 234 are all joined at central portion 180 in the current embodiment, in other embodiments two or more connecting portions could be disjoined. For example, in an alternative embodiment, first connecting portion 231 may be joined to second connecting portion 232, but first connecting portion 231 may not be joined to third connecting portion 233 or fourth connecting portion 234. Likewise, third connecting portion 233 and fourth connecting portion 234 could be joined together, but neither third connecting portion 233 or fourth connecting portion 234 may be joined to first connection portion 231 or second connecting portion 233.

For purposes of discussing the geometry of first slot 211, second slot 212 and third slot 213, each slot can be generally associated with a first end portion, a second end portion and an intermediate portion. In the current embodiment, first slot 211 includes first end portion 321 disposed adjacent to lateral upper periphery 162 and second end portion 322 disposed adjacent to lateral lower periphery 164. First slot 211 also includes first intermediate portion 328 disposed between first end portion 321 and second end portion 322. Third slot 213 includes third end portion 323 disposed adjacent to lateral lower periphery 164 and fourth end portion 324 disposed adjacent to medial lower periphery 168. Third slot 213 also includes second intermediate portion 329 disposed between third end portion 323 and fourth end portion 324. Second slot 212 includes fifth end portion 325 and sixth end portion 326, disposed adjacent to medial lower periphery 168 and medial upper periphery 166, respectively. Second slot 212 also includes third intermediate portion 330 disposed between fifth end portion 325 and sixth end portion 326.

In some embodiments, the geometry of one or more slots can vary. For example, in the current embodiment, first slot 211, second slot 212 and third slot 213 have triangular or wedge-like geometries. In particular, the depth of each slot varies. For example, in one embodiment, first slot 211 may have a depth D1 at first end portion 321. Additionally, first slot 211 may have a depth D2 at first intermediate portion 328. In some cases, depth D1 and depth D2 can have similar values. In other cases, the values of depth D1 and depth D2 can be substantially different. In the exemplary embodiment, depth D1 may have a smaller value than depth D2. In other words, the depth of first slot 211 may increase from first end portion 321 to first intermediate portion 328. Additionally, the depth of first slot 211 may increase between second end portion 322 and first intermediate portion 328. In a similar manner, the depth of second slot 212 may increase between fifth end portion 325 and third intermediate portion 330, as well as between sixth end portion 326 and third intermediate portion 330. Also, the depth of third slot 213 may increase between third end portion 323 and second intermediate portion 329, as well as between fourth end portion 324 and second intermediate portion 329.

In some embodiments, the depths of different slots can change in various ways. In some cases, the depth of first slot 211 may vary in a linear manner between second end portion 322 and first intermediate portion 328. In contrast, the depth of first slot 211 may vary in a nonlinear manner between first end portion 321 and first intermediate portion 328. In a similar way, some other slots of plurality of slots 200 may vary linearly or nonlinearly. For example, in the current embodiment, third slot 213 has a depth that varies in a linear manner between third end portion 323 and second intermediate portion 329 as well as between fourth end portion 324 and second intermediate portion 329. In other embodiments, the depths of one or more slots may be substantially constant. For example, in an alternative embodiment, some slots could have substantially rectangular shapes with constant depths.

By varying the geometries of each slot, including the depths, the flexibility and rigidity of the associated connecting portions can be fine tuned. For example, in the exemplary embodiment, the wedge or triangular shapes of each slot helps to form connecting portions that may easily flex or bend away from one another to allow the upper portion of the sole structure to partially decouple from the lower portion of the sole structure. In particular, in some cases, first connecting portion 231 can be configured to move somewhat independently of second connecting portion 232, which helps to partially decouple lateral upper periphery 162 from lateral lower periphery 164. Likewise, third connecting portion 233 can be configured to move somewhat independently of fourth connecting portion 234, which helps to partially decouple medial upper periphery 166 from medial lower periphery 168. With this arrangement, lower portion 154 of sole structure 110 can remain planted on a ground surface while upper portion 152, which supports a foot, can move somewhat independently to increase overall flexibility, fit and stability.

An article of footwear including slots can be formed in any manner. In some embodiments, a sole structure can be molded in a manner that creates slots in the sloe structure. In other embodiments, slots can be created in a sole structure using any known methods of cutting. For example, in one embodiment, slots can be created using laser cutting techniques. Specifically, in some cases, a laser can be used to remove material from a sole structure in a manner that forms slots in the sole structure. In another embodiment, a hot knife process could be used for forming slots in a sole structure. Examples of methods for forming slots on a sole structure are disclosed in U.S. Patent Application Publication Number 2008/0022553, to McDonald, the entirety of which is hereby incorporated by reference. Other examples of methods that could be used for forming slots are disclosed in U.S. Ser. No. 12/428,501, filed on Apr. 23, 2009, the entirety of which is hereby incorporated by reference. In other embodiments, however, any other type of cutting method can be used for forming slots. Furthermore, in some cases, two or more different techniques can be used for forming slots. As an example, in another embodiment, slots disposed on a side portion of a sole structure can be formed using laser cutting, while slots on a lower portion of the sole structure could be formed during a molding process. Still further, different types of techniques could be used according to the material used for a sole structure. For example, laser cutting may be used in cases where the sole structure is made of a foam material.

Figure 7:
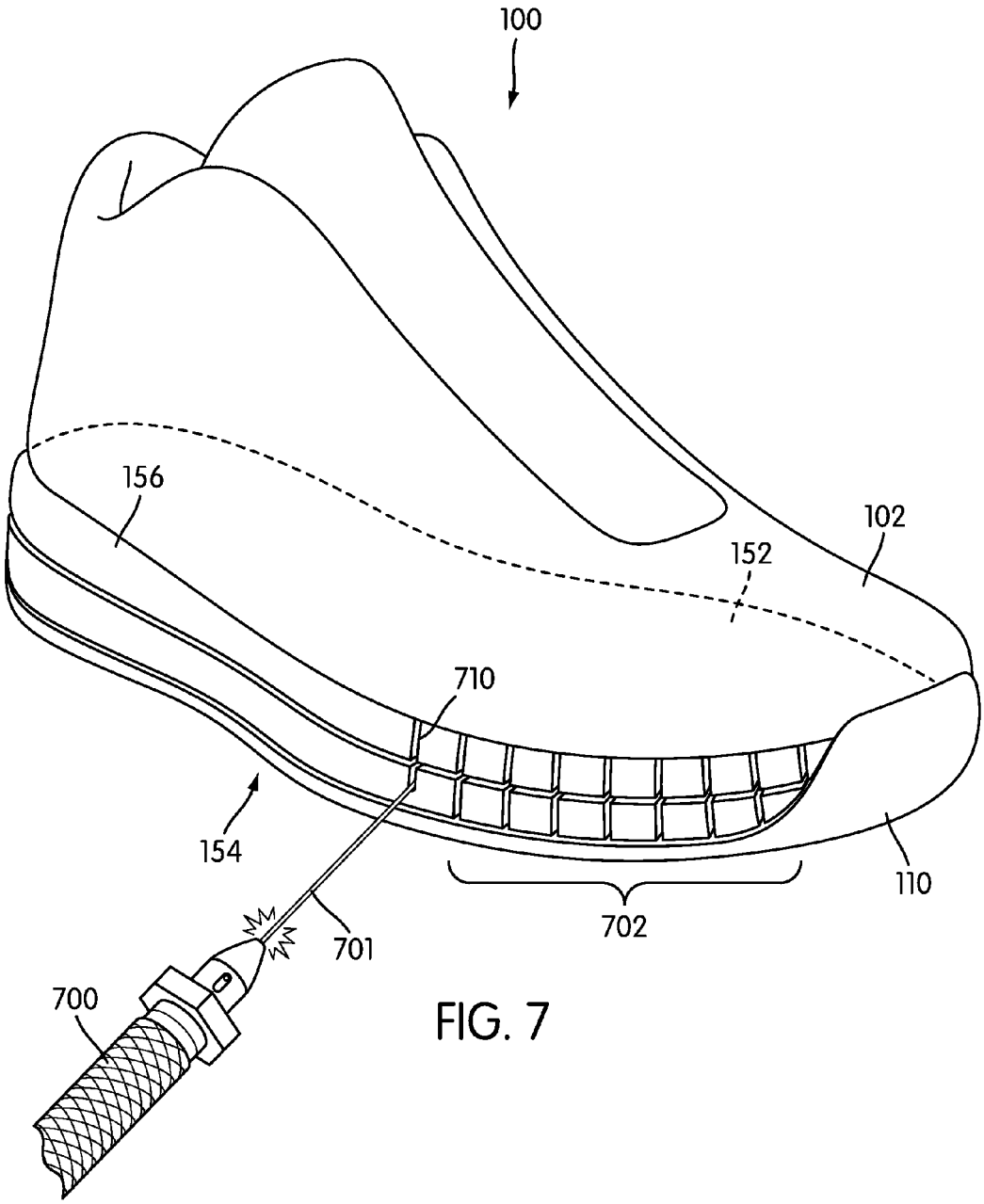
FIG. 7 is an isometric view of an embodiment of a method of forming slots in a sole structure.

FIGS. 7 through 10 illustrate a method of making an article of footwear including a plurality of slots. Referring to FIG. 7, slots can be applied to sole structure 110 using laser 700. In this case, first group of slots 702 has already been formed in lateral side portion 156. At this point, fourth slot 710 is being formed by dragging laser beam 701 between upper portion 152 and lower portion 154 of sole structure 110. Although only slots on lateral side portion 156 are shown in this example, it will be understood that a similar method could be used for creating slots in lower portion 154 as well as in medial side portion 158.

Figure 8:
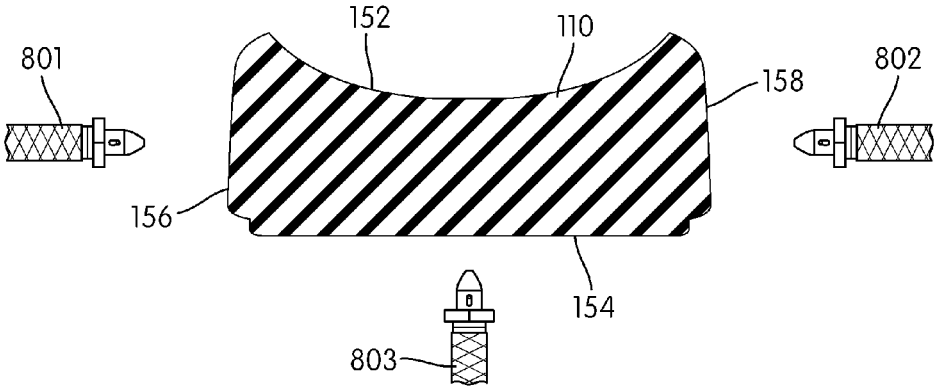
FIG. 8 is a schematic cross-sectional view of an embodiment of a sole structure prior to forming a plurality of slots.
Figure 9:
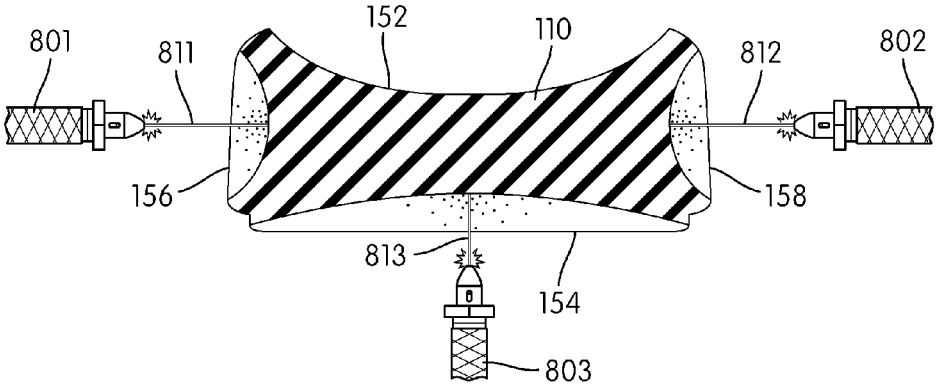
FIG. 9 is a schematic cross-sectional view of an embodiment of a sole structure during a process of forming a plurality of slots.
Figure 10:
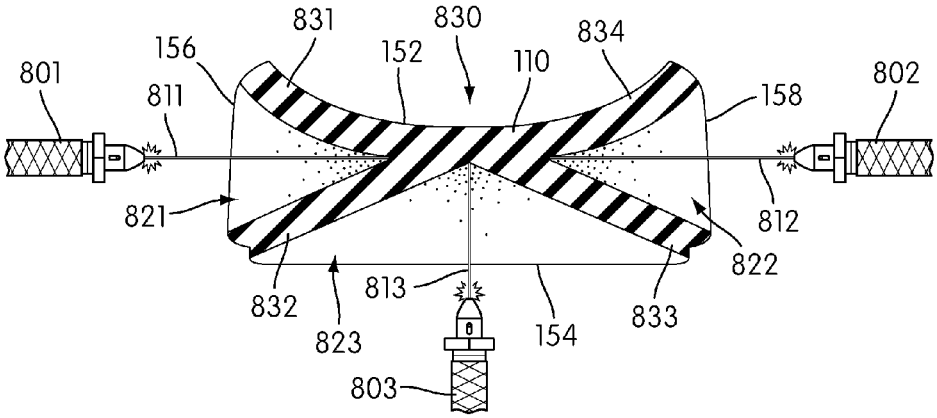
FIG. 10 is a schematic cross-sectional view of an embodiment of a sole structure with a plurality of slots.

Referring to FIGS. 8 through 10, multiple lasers could be used to simultaneously form three longitudinally aligned slots in sole structure 110. During a first step, illustrated in FIG. 8, first laser 801, second laser 802 and third laser 803 may be associated with lateral side portion 156, medial side portion 158 and lower portion 154, respectively. Following this, during a second step that is illustrated in FIG. 9, first laser 801, second laser 802 and third laser 803 may all be turned on so that first beam 811, second beam 812 and third beam 813 begin cutting through sole structure 110. Finally, during a third step that is illustrated in FIG. 10, first laser 801, second laser 802 and third laser 803 may remove material so that first slot 821, second slot 822 and third slot 823 are formed in their entirety. Furthermore, the remaining material after first slot 821, second slot 822 and third slot 823 have been formed may comprise connecting member 830. Connecting member 830 may further include first connecting portion 831, second connecting portion 832, third connecting portion 833 and fourth connecting portion 834.

In some embodiments, the arrangement of slots on a sole structure could be varied to tune properties of the sole structure for specific types of athletic activities. For example, in some cases, the arrangement of slots on a sole structure could be selected according to the type of sport for which the article of footwear is intended. In some embodiments, a manufacturer could vary the arrangement of slots for various types of footwear, including, but not limited to, soccer footwear, running footwear, cross-training footwear, basketball footwear, as well as other types of footwear. Additionally, in other embodiments, the arrangement of slots on a sole structure could be varied according to the gender of the intended user. For example, in some cases, the slots arrangements may vary between footwear for men and footwear for women. Still further, in some embodiments, the arrangement of slots on a sole structure could be varied according to preferences of a user for achieving desired performance effects. As an example, a desire for increased flexibility on a lateral side of the article can be accommodated by increasing the number and/or geometry of slots on the lateral side of the sole structure. In addition, in some embodiments, the configuration of a slots on a sole could be varied to achieve various visual or graphical effects.

Methods of customizing a slot configuration for particular sports, gender and/or personal preferences can be achieved in any manner. In one embodiment, a method of customizing a slot configuration for an article can include provisions for allowing a user to select a customized slot arrangement by interacting with a website that provides customization tools for varying the number and/or geometry of various slots. Examples of different customization systems that can be used for customizing slot configurations are disclosed in U.S. Patent Application Publication Number 2005/0071242, to Allen, and U.S. Patent Application Publication Number 2004/0024645, to Potter et al., the entirety of both being hereby disclosed by reference. It will be understood that the method of customizing slot arrangements for an article of footwear are not limited to use with any particular customization system and in general any type of customization system known in the art could be used.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. In an exemplary embodiment, materials for a sole structure can be selected to enhance the overall flexibility, fit and stability of the article. In one embodiment, a foam material can be used with sole structure, as foam can provide the desired elasticity and strength. In another embodiment, a rubber material could be used to make a midsole of a sole structure. In still another embodiment, a thermoplastic material could be used with a sole structure. For example, in one embodiment, thermoplastic polyurethane (TPU) may be used to make a midsole for a sole structure. In still other embodiments, a sole structure may comprise a multi-density insert that comprises at least two regions of differing densities. For example, in one other embodiment, a midsole of a sole structure could be configured to receive one or more inserts. Examples of different types of inserts that could be used are disclosed in U.S. Patent Application Publication Number 20080244926, to Yu, the entirety of which is hereby incorporated by reference. Also, an upper may be made from any suitable material, including, but not limited to: nylon, natural leather, synthetic leather, natural rubber or synthetic rubber.

It will be understood that in different embodiments, slots could be associated with various different portions of a sole structure. In some cases, slots could be associated with a majority of the length of the sole structure. In other cases, slots could be associated with only some portions of a sole structure. For example, in some cases, slots could be disposed on a forefoot portion of a sole structure. In other cases, slots could be disposed on a midfoot portion of a sole structure. In still other cases, slots could be disposed on a heel portion of a sole structure. Moreover, in some cases, slots could be disposed on a single side of a sole structure, such as the medial or lateral side. In still other cases, slots could be disposed only on a lower portion of a sole structure. In embodiments where slots are only disposed on some portions of a sole structure, the sole structure could include additional provisions for enhancing support and/or comfort. These different provisions could include, but are not limited to airbags, bladders and cushions.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure including a side portion, a lower portion and a lower periphery disposed between the side portion and the lower portion;

a first slot disposed in the side portion and a second slot disposed in the lower portion;

wherein the first slot extends inward from an outer surface of the side portion to a central portion of the sole structure;

the first slot having a first end portion disposed adjacent to the lower periphery;

the second slot having a second end portion disposed adjacent to the lower periphery;

a connecting portion extending to the lower periphery; and wherein the connecting portion separates the first slot from the second slot, wherein the first slot has a first front wall and a first rear wall;

wherein the second slot has a second front wall and a second rear wall; and wherein the first front wall approximately corresponds to the second front wall and the first rear wall approximately corresponds to the second rear wall.

2. The article of footwear according to claim 1, wherein:

the first slot has a first front wall and a first rear wall;

the sole structure further includes a second side portion opposite the side portion and a second lower periphery disposed between the second side portion and the lower portion; the article of footwear further comprises a third slot disposed in the second side portion and a second connecting portion extending to the second lower periphery; and;

the third slot extends inward from an outer surface of the second side portion to a central portion of the sole structure;

the third slot having a third end portion disposed adjacent to the lower periphery;

the connecting portion separating the third slot from the second slot;

the third slot has a third front wall and a third rear wall; and the third front wall approximately corresponds to the second front wall and the third rear wall approximately corresponds to the second rear wall.

3. The article of footwear according to claim 1, wherein the first slot extends between the lower portion of the sole structure and an upper portion of the sole structure disposed opposite of the lower portion.

4. The article of footwear according to claim 1, wherein the second slot extends between a medial side of the lower portion and a lateral side of the lower portion.

5. The article of footwear according to claim 1, wherein the side portion includes a longitudinal slot that extends between a heel portion of the article and a forefoot portion of the article.

6. The article of footwear according to claim 5, wherein the longitudinal slot intersects the first slot.

7. An article of footwear, comprising:

a sole structure including a side portion, a lower portion and an upper portion;

a lower periphery disposed between the side portion and the lower portion;

an upper periphery disposed between the side portion and the upper portion;

a first slot disposed in and extending inward from an outer surface of the side portion and a second slot disposed in and extending inward from an outer surface of the lower portion;

a first connecting portion being disposed between a first portion of the first slot and the upper portion, the first connecting portion extending to the upper periphery;

a second connecting portion being disposed between a second portion of the first slot and a portion of the second slot, the second connecting portion extending to the lower periphery;

wherein the first connecting portion is configured to move substantially independently of the second connecting portion; and the side portion extending inward from the lower periphery to the upper periphery of the sole structure, thereby forming a vertical sidewall of the sole structure.

8. The article of footwear according to claim 7, wherein the second connecting portion separates the first slot from the second slot.

9. The article of footwear according to claim 7, wherein the first slot includes a first end portion, a second end portion and a first intermediate portion disposed between the first end portion and the second end portion and wherein the depth of the first slot increases between the first end portion and the first intermediate portion and between the second end portion and the first intermediate portion.

10. The article of footwear according to claim 9, wherein the second slot includes a third end portion, a fourth end portion and a second intermediate portion disposed between the third end portion and the fourth end portion and wherein the depth of the second slot increases between the third end portion and the second intermediate portion and between the fourth end portion and the second intermediate portion.

11. The article of footwear according to claim 7, wherein the first slot is substantially aligned with the second slot in the longitudinal direction.

12. The article of footwear according to claim 9, wherein the depth of the side slot increases linearly from the first end portion to the intermediate portion.

13. The article of footwear according to claim 9, wherein the first connecting portion has a substantially nonlinear shape.

14. The article of footwear according to claim 10, wherein the second connecting portion has a substantially linear shape.

15. An article of footwear, comprising:

a sole structure comprising a lateral side portion, a medial side portion and a lower portion;

the sole structure further comprising a first portion and a second portion, the first portion and the second portion having an approximately rectangular cross-sectional shape;

a hollowed out portion disposed longitudinally between the first portion and the second portion, the hollowed out portion comprising a first slot disposed on the lateral side portion, a second slot disposed on and extending inward from an outer surface of the medial side portion and a third slot disposed on and extending inward from an outer surface of the lower portion;

the hollowed out portion further comprising a first connecting portion associated with a lateral upper periphery of the sole structure, a second connecting portion associated with a lateral lower periphery of the sole structure, a third connecting portion associated with a medial lower periphery of the sole structure and a fourth connecting portion associated with a medial upper periphery of the sole structure;

wherein the first connecting portion is attached to the second connecting portion and wherein the third connecting portion is attached to the fourth connecting portion; and wherein the first slot extends inward from an outer surface of the lateral side portion to a central portion of the sole structure.

16. The article of footwear according to claim 15, wherein the first connecting portion is attached to the fourth connecting portion.

17. The article of footwear according to claim 15, wherein the second connecting portion is attached to the third connecting portion.

18. The article of footwear according to claim 15, wherein the first connecting portion, the second connecting portion, the third connecting portion and the fourth connecting portion form an approximately X-like cross sectional shape.

19. The article of footwear according to claim 15, wherein the first connecting portion, the second connecting portion, the third connecting portion and the fourth connecting portion provide substantial decoupling between the first portion and the second portion of the sole structure.

20. The article of footwear according to claim 15, wherein the second connecting portion separates the first slot from the third slot; and the third connecting portion separates the second slot from the third slot.

* * * * *